United States Patent [19]

Asano et al.

[11] 4,075,982

[45] Feb. 28, 1978

[54] CLOSED-LOOP MIXTURE CONTROL SYSTEM FOR AN INTERNAL COMBUSTION ENGINE WITH MEANS FOR IMPROVING TRANSITIONAL RESPONSE WITH IMPROVED CHARACTERISTIC TO VARYING ENGINE PARAMETERS

[76] Inventors: Masaharu Asano, No. 964, Shimonagaya-cho, Yokohama; Kokichi Ochiai, No. 2-8-2, Nishitomi, Fujisawa, both of Japan

[21] Appl. No.: 678,598

[22] Filed: Apr. 20, 1976

[30] Foreign Application Priority Data

Apr. 23, 1975 Japan ..... 50-48605

[51] Int. Cl.[2] ..... F02B 33/00; F02B 3/00; F02B 7/00

[52] U.S. Cl. ..... 123/32 EH; 123/32 EL; 123/32 EE; 123/32 ED; 123/119 EC; 60/276; 60/285

[58] Field of Search ..... 123/32 EH, 32 EI, 32 EE, 123/119 EC; 60/276, 285

[56] References Cited

U.S. PATENT DOCUMENTS

| | | | |
|---|---|---|---|
| 3,548,792 | 12/1970 | Palmer | 123/119 EC |
| 3,672,345 | 6/1972 | Monpetit | 123/32 EH |
| 3,759,232 | 9/1973 | Wahl et al. | 123/32 EA |
| 3,998,189 | 12/1976 | Aoki | 60/276 |

FOREIGN PATENT DOCUMENTS

| | | | |
|---|---|---|---|
| 2,241,694 | 3/1975 | France | 123/32 EH |

*Primary Examiner*—Ronald B. Cox
*Attorney, Agent, or Firm*—Robert E. Burns; Emmanuel J. Lobato; Bruce L. Adams

[57] ABSTRACT

A closed-loop mixture control system for an internal combustion engine comprises a throttle position sensor and a compensator connected thereto to provide an error compensating signal in response to a throttle change. The signal is feedforwarded to adjust the air-fuel ratio to the varying engine parameters prior to the generation of control signals.

6 Claims, 4 Drawing Figures

CLOSED-LOOP MIXTURE CONTROL SYSTEM FOR AN INTERNAL COMBUSTION ENGINE WITH MEANS FOR IMPROVING TRANSITIONAL RESPONSE WITH IMPROVED CHARACTERISTIC TO VARYING ENGINE PARAMETERS

BACKGROUND OF THE INVENTION

The present invention relates to mixture control systems for an internal combustion engine, and in particular to a closed-loop mixture control system using an exhaust composition sensor and a catalytic converter wherein the system can adapt to varying engine operating conditions.

Closed-loop mixture control systems using an exhaust composition sensor and a catalytic converter are known in the art. However, due to the inherent time delay in the feedback control loop, the introduction of a sudden change to the operating conditions of an internal combustion engine will result in the generation of an inappropriate control signal during transitional periods and thus the system cannot adapt precisely to varying engine operating conditions. Such abrupt changes are often triggered by sudden shifting of throttle positions as the vehicle is accelerated or decelerated.

SUMMARY OF THE INVENTION

Therefore, an object of the invention is to provide an improved mixture control system of a feedback controlled type which compensates for the time delay from the time of introduction of a sudden change to the operating parameters of the control loop to the time of application of a new control signal for the varying parameters of the loop.

According to the present invention, there is provided an air-fuel mixture control system for an internal combustion engine wherein an exhaust composition of the engine is detected for controlling the air-fuel ratio of the mixture through a feedback loop at a predetermined value, comprising means for detecting an abrupt change in the operating conditions of the engine, means for generating an error compensating signal upon the detection of the abrupt change, the error compensating signal having a duration equal to or greater than the transitional period of the abrupt change, and means for combining the error compensating signal with a control signal representing the detected exhaust composition.

The error compensating signal varies substantially at the same rate as the variation of engine parameters in order to increase or decrease air-fuel ratio depending on the direction of change (acceleration of deceleration). Therefore, the deficient or excessive supply of fuel during the transitional period ranging from the time of occurrence of that change to the time of delivery of a new control signal representing the varying engine conditions, is compensated for through a feedforward loop.

BRIEF DESCRIPTION OF THE DRAWINGS

The invention will be further described by way of example in the following description taken in conjunction with the accompanying drawings, in which.

DESCRIPTION OF THE PREFERRED

Figure 1:
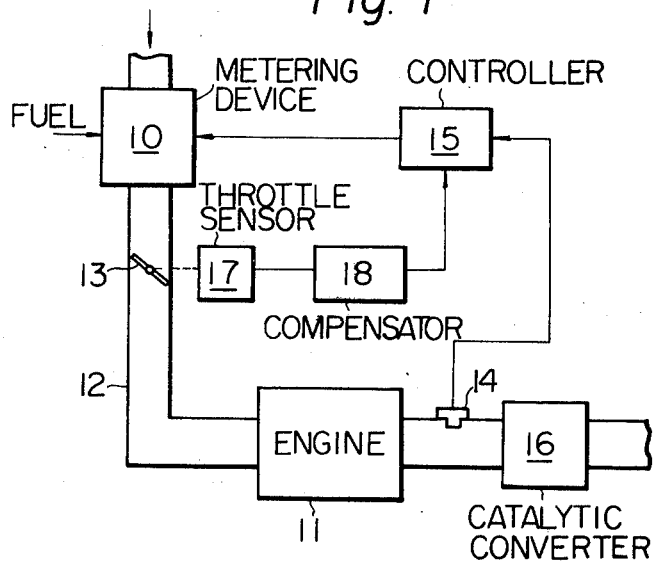
FIG. 1 is a schematic illustration of a mixture control system embodying the invention.
Figure 2:
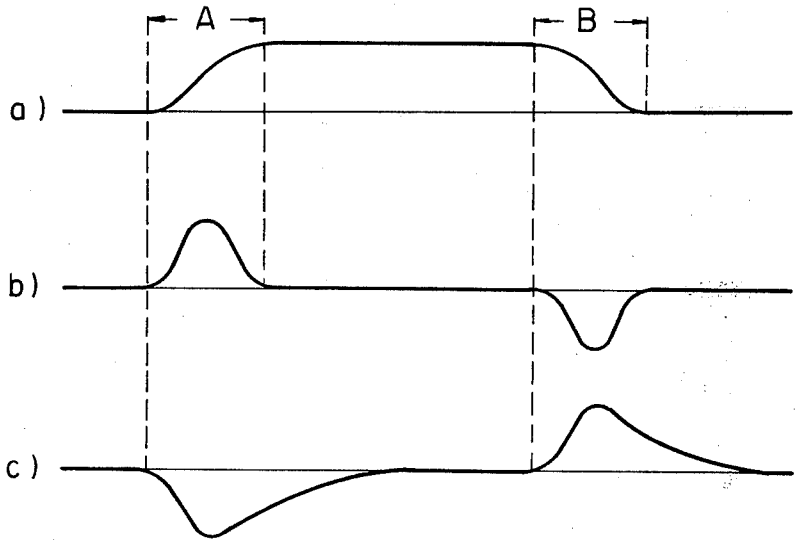
FIG. 2 is a waveform diagram of an error compensating signal in relation to the occurrence of a change in throttle position.
Figure 3:
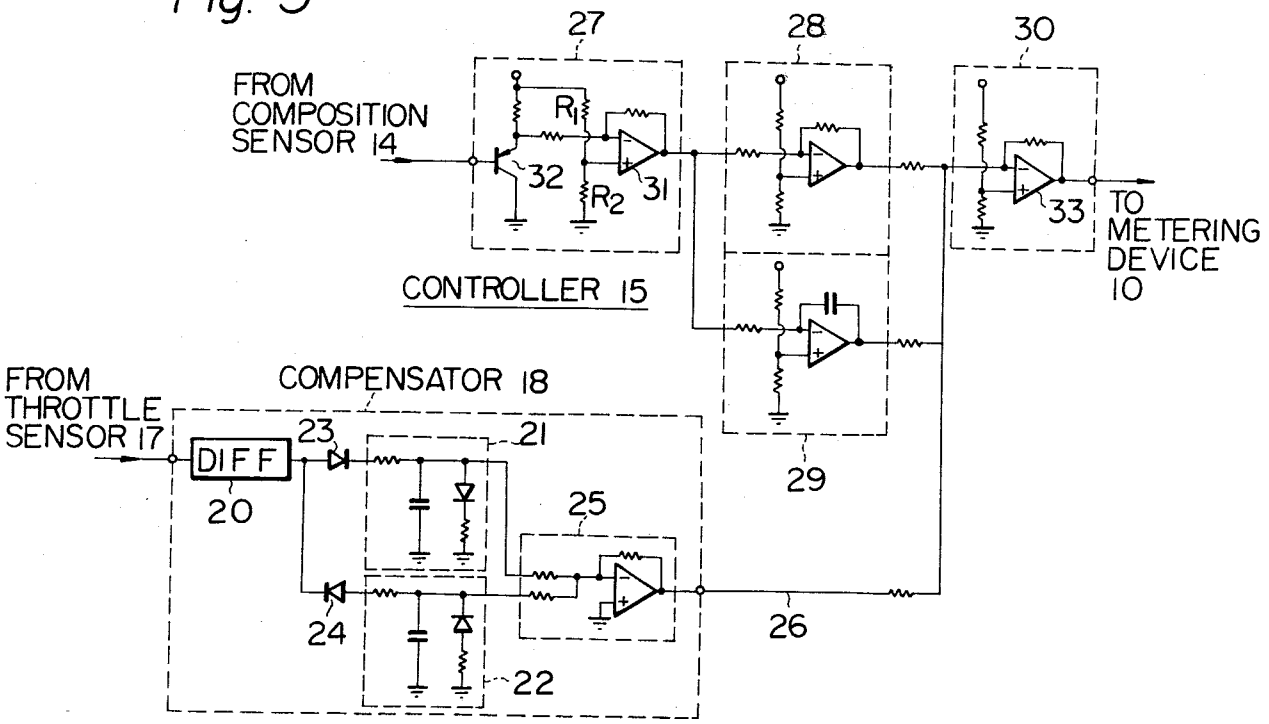
FIG. 3 is a detailed circuit diagram of a compensator and a controller illustrated in FIG. 1.

Referring now to FIG. 1, an embodiment of the present invention is schematically shown. A fuel metering device 10 such as a conventional carburetor supplies airfuel mixtures to the cylinders of an internal combustion engine indicated by 11 through inlet pipe 12 in which a throttle valve 13 is disposed in conventional manner. A catalytic converter 16, such as a three-way catalyst type, is provided at the exhaust pipe of the engine to convert the exhaust emissions to harmless water vapor and carbon dioxide. The three-way catalytic converter operates at a maximum conversion efficiency within a small window of air-fuel ratios which is usually called "stoichiometric air-fuel ratio". In order to maintain the mixture within the stoichiometric window, an exhaust composition sensor 14 is provided between the exhaust side of the engine and the inlet of the catalytic converter 16. This sensor may be a conventionally available zirconium dioxide oxygen sensor which detects the presence of oxygen and provides an output having a steep transition in amplitude at the stoichiometric air-fuel ratio. The signal from the oxygen sensor 14 is thus an indication of whether the mixture is above or below the stoichiometric value and fed to the metering device 10 through a controller 15. Since there is a time delay from the time of delivery of a control signal to the metering system 10 to the time of detection of oxygen concentration after combustion, the controller 15 modulates the amplitude of the signal from the oxygen sensor in accordance with a predetermined amplification characteristic so that the system can adapt to varying engine operating conditions as long as the rate of variation is comparatively small. However, the system cannot follow up sudden changes as effected by throttling operations because of the delay from the time of occurrence of the change to the time of application of the control signal. During this delay time the engine will be operated at an inappropriate air-fuel ratio for the transitional operation. In order to compensate for the delay interval, a throttle piston sensor 17 is operatively connected to the throttle valve 13. This position sensor generates a signal whose amplitude varies correspondingly with the instantaneous position of the throttle. An example of the waveform of a signal from the position sensor 17 is shown in FIG. 2*a*. During a transitional period A the signal from the sensor 17 increases continuously with the shifting position of throttle 13 until it reaches a stable value where the throttle 13 takes a new stable position, and similarly, during a transitional period B the signal from the sensor 17 decreases continuously with the shifting position of the throttle 13 until it reaches the original value with the throttle being in the previous position. The throttle position sensor 17 feeds its output to a compensator 18 which is turn generates a delay compensating signal to the controller 15 to be described hereinbelow FIG. 3 illustrates a detailed circuit of both the compensator 18 and the controller 15 which is associated with the compensator for compensation of an error resulting from the inherent delay time of the engine. The compensator 18 comprises a differentiator 20 coupled to the output of throttle position sensor 17 and feeds its output to an RC delay network 21 through diode 23 poled to pass those signals having positive polarity and also to an RC delay network 22 through diode 24 poled to pass those signals having negative polarity. The positive signal is generated during the transitional period A when the vehicle is accelerated and the negative signal is generated during the transitional period B when the vehicle is decelerated. Each of the RC networks introduces a lag of first order to the input signal applied thereto so that the duration of the output is longer than the transitional period A or B as seen in FIG. 2*c*. Since there is a delay time from the time of occurrence of the change in throttle position to the time of delivery of a control signal resulting from that change, the duration of the signal from each RC network is determined in relation to the length of the time delay. Outputs from the RC networks 21, 22 are applied to the controller 15 on lead 26 through an inverter 25.

Controller 15 comprises generally a comparator or level detector 27, a proportional controller 28, an integral controller 29 and a summing circuit 30. The output from the oxygen sensor 14 is fed to a differential amplifier 31 of comparator 27 through an amplifier transistor 32 for comparison with a DC voltage from a voltage dividing resistor network formed by a pair of series-connected resistors R1, R2. Since the output of oxygen sensor 14 varies steeply at the stoichiometric air-fuel ratio, the output from the comparator 27 is a signal of opposite polarities depending on whether the air-fuel ratio is above on below the pedetermined value. The output from the comparator 27 is fed to the proportional controller 28 for comparison with a DC voltage from a voltage dividing resistor network as illustrated to provide a signal of a polarity opposite to the sign of the comparator output. The integral controller 29 is also fed with the signal from the comparator 27 to generate an output which is an integral amplification of the comparator output with the signal polarity opposite to the sign of the comparator output. The outputs from the proportional and integral controllers and from the inverter 25 of the compensator 18 are connected through respective resistors in common to the inverting input of an operational amplifier 33 of the summing circuit 30. As will be seen in FIG. 2*c*, a negative error compensating signal appears during the transitional period A prior to the occurrence of the resultant control signal so that the initial delay time is compensated for by addition of the absolute values of the two signals, while a positive error compensating signal appears during the transitional period B before the control signal has changed to a new value and the resultant delay in period B is compensated for by subtraction of the absolute values of the two signals.

Figure 4:
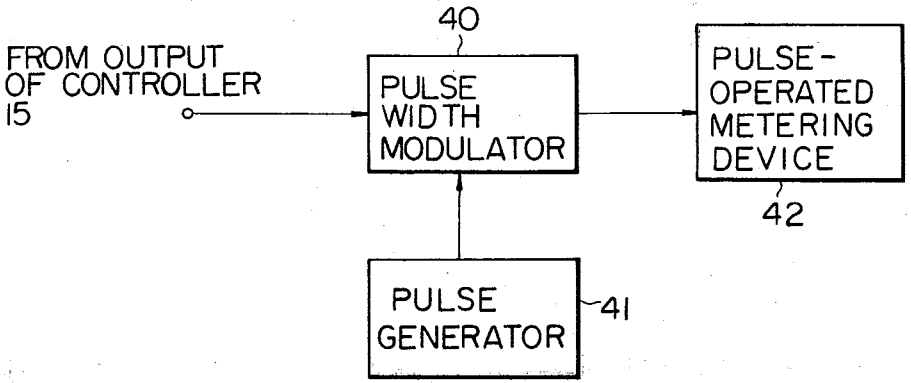
FIG. 4 is a schematic illustration of a circuit for controlling a pulse-operated metering device.

The metering device 10 may be of a pulse-operated type such as electronic fuel injection or carburetors using on-off control valves. In FIG. 4, the output from controller 15 is supplied to a pulse width modulator 40 for analog-to-digital conversion. A pulse generator 41 supplies a train of pulses at a constant frequency to the modulator 40. The width of the pulse is modulated in accordance with the amplitude of the signal applied thereto from controller 15 in order that the operating time of the pulse-operated metering device 42 is determined by the modulated pulse duration.

What is claimed is:

1. An air-fuel mixture control system for an internal combustion engine wherein an exhaust composition of the engine is detected for controlling the air-fuel ratio of the mixture through a feedback loop at a predetermined value, comprising:

means for detecting an operating parameter of the engine indicative of a rich mixture or a lean mixture transitory demand condition;

means for generating an error compensating signal including means for differentiating the output from said detecting means, a first delay network effective to extend the duration of an input signal applied thereto to shape the input signal into a signal waveform having exponential slopes, a second delay network effective to extend the duration of an input signal applied thereto to shape the input signal into a signal waveform having exponential slopes, first polarity sensitive means connected to the output of the differentiating means for passing signals of a first polarity to said first delay network, and a second polarity sensitive means connected to the output of the differentiating means for passing signals of a second polarity to said second delay network to produce alternatively at the output of said first and second networks an output signal to represent said error compensating signal; and means for combining the error compensating signal with a control signal representing the detected exhaust composition.

2. A mixture control system as claimed in claim 1, further comprising a proportional controller connected to receive an exhaust composition representative signal representing variations in the composition the detected exhaust composition, an integrating controller connected to receive said exhaust composition representative signal, and a summing circuit connected to the output of the proportional and integrating controllers and to the output of the first and second delay networks.

3. A mixture control system as claimed in claim 1, wherein a catalytic converter is provided at the exhaust side of the engine and to convert the exhaust emissions into harmless material at maximum conversion efficiency when the air-fuel ratio is maintained at said predetermined value, and wherein means are provided for detecting exhaust composition of the engine at the entry side of the catalytic converter.

4. A mixture control system for an internal combustion engine having a throttle and wherein an exhaust composition of the engine is detected for controlling the air-fuel ratio of the mixture through a feedback control loop at a predetermined value, comprising means in said loop for detecting the exhaust composition to generate an exhaust composition signal representing the composition of the detected composition, circuit means in said loop for modulating the amplitude of the exhaust composition representative signal into a control signal suitable for feedback control, means in said loop for supplying the mixture in accordance with the control signal, means for detecting throttle positions for generating a throttle position indicating signal corresponding to the position of the throttle;

means for generating an error compensation signal of opposite polarities in dependence upon the position of the throttle, including means for differentiating the signal from said throttle position detecting means, a first RC network having a time constant longer than the duration of an input signal applied thereto, a second RC network having a time constant longer than the duration of an input signal applied thereto, first polarity sensitive means connected to the output of the differentiating means and effective to pass signals of a first polarity to said first RC network, and a second polarity sensitive means and effective to pass signals to said second RC network to provide an output from said first and second networks to represent said error compensation signal; and means for combining said error compensation signal with said control signal.

5. A mixture control system as claimed in claim 4, wherein said signal combining means comprises a proportional controller connected to receive said exhaust composition representative signal, an integrating controller connected to receive said exhaust composition representative signal, and a summing circuit connecting to the output of the proportional and integrating controllers and to the output of the first and second RC networks.

6. A mixture control system as claimed in claim 4, wherein a catalytic converter is provided at the exhaust side of the engine downstream of said exhaust composition detecting means and effective to convert the exhaust emissions into harmless material at the maximum conversion efficiency when the air-fuel ratio is maintained at said predetermined value.

* * * * *